US005282880A

United States Patent [19]

Olson

[11] Patent Number: 5,282,880

[45] Date of Patent: Feb. 1, 1994

[54] LOW PRESSURE PLASMA METAL EXTRACTION

[76] Inventor: Larry K. Olson, 412 S. Gilman, Litchfield, Minn. 55355

[21] Appl. No.: 945,096

[22] Filed: Sep. 15, 1992

[51] Int. Cl.[5] ..... C22B 21/00

[52] U.S. Cl. ..... 75/10.19; 75/677

[58] Field of Search ..... 75/10.19, 677

[56] References Cited

U.S. PATENT DOCUMENTS 3,853,541 12/1974 Othmer ..... 75/677

*Primary Examiner*—Peter D. Rosenberg

*Attorney, Agent, or Firm*—N. Paul Friederichs; Norman P. Friederichs

[57] ABSTRACT

Removing contaminants from a contaminated ore through volatilization in a low pressure environment, subjecting the ore to a plasma and a reactive gas in a low pressure environment to form a metallic salt, volatilizing the salt and collecting the salt via condensation.

57 Claims, 4 Drawing Sheets

LOW PRESSURE PLASMA METAL EXTRACTION

BACKGROUND OF THE INVENTION

The present invention relates to the extraction of metals from ore, and more particularly to a process for extracting metals from ore wherein the ore is exposed to a particular gaseous environment such that the metals react with a reactive gas in the environment, extracting metals from the ore as salts.

The extraction of metals from ore can be performed by a number of mechanical and chemical processes known in the mining industry. These processes included leaching, panning and other methods of gravity separation, centrifugal separation, electro-chemical reduction and similar known methods of process metallurgy. These various processes have generally proven economically successful when used on ore wherein the metal particles are large, and also when the metal values (i.e. concentrations of the metals as a percentage of the ore) are high. These known processes become uneconomical when the metal particles become too small or the metal values in the ore become too small. The present invention is a new process which uses a plasma for extracting metals from ore. The process of the present invention can economically extract smaller particles and smaller metal values than previous known processes.

Plasmas are electrically neutral, highly ionized gasses which can be generated by electrically heating a low-pressure gas. While plasmas exhibit microscopic properties much like ordinary gasses, plasmas also exhibit collective or fluid-like properties which are markedly different form ordinary gasses. Plasmas can conduct electricity, are responsive to magnetic fields, and can propagate various kinds of waves. Plasmas may exist in an uncontrolled, freely changing form, or may be carefully regulated and constrained between electrodes in a constant maintained form. Examples of uncontrolled plasmas include lightning and arc welding, and an example of a controlled plasma is fluorescent lighting.

While plasmas have been used for a variety of purposes, they are particularly useful as a source of high intensity heating, such as in arc welding. However, as the extraction of metals from ore has generally been performed using low temperature processes, the heating and other effects of plasmas have not generally been used in process metallurgy.

Plasmas have been used as a source of high intensity heat to vaporize fine particle products in recovery of valuable metals from slag or low grade concentrate. U.S. Pat. No. 3,989,512 to Sayce discloses use of a column of uncontrolled plasma projected from jets in this manner. A low grade tin concentrate may be fed as a stream of fine particles born in a carrier gas stream into the plasma column. The particulate material is heated to temperatures of 1,600° to 2,000° C., thereby vaporizing tin from the particulate into stannic oxide fume.

The temperatures involved in using the uncontrolled plasma jets described by the Sayce patent create particular problems. The material of the plasma inducing electrode may itself volatilize, stopping the reaction process. The Sayce patent suggests surrounding the electrodes with an inert gaseous environment such as argon or nitrogen to limit volatilization of the electrodes. The electrodes and the surrounding structure of the device used must be made of materials which can withstand the high temperature created by the plasma.

SUMMARY OF THE INVENTION

The present invention is designed to remove contaminants and metals from a contaminated ore. The process has two phases. In the first phase contaminants such as carbon monoxide, carbon dioxide, water and sulfur are removed from the contaminated ore through volatilization. The second phase recovers the metal values. Contaminants are particles that are not essential in the reaction of the second phase. A contaminated ore is any substance containing contaminants and having a component that will not volatilize in the first phase. The contaminated ore may also contain a metal that can be removed in the second phase. A metal is any electropositive particle that may be removed in the second phase. Although the present invention contemplates a contaminated ore passing through both the first and second phases, it should be recognized that processing the ore through the first phase is not essential to the present invention.

The first phase of the present invention includes an outgas assembly that defines an outgas chamber. A vacuum pump is provided for depressurizing the outgas chamber to a pressure perhaps as low or lower than 1 Torr. The contaminated ore is placed in the outgas chamber such that the low pressure volatilizes the contaminants. The contaminants may be collected on condensers if desired.

An outgas hopper may introduce the contaminated ore into the outgas chamber. In such a case, an outgas conveyor belt may receive and carry the contaminated ore through the chamber. An ore collection bin may collect the ore at the end of the outgas conveyor belt. One or more heaters may be placed underneath the outgas conveyor belt to help initiate volatilization of the contaminants.

Once the contaminants have volatilized, they may be collected on one or more outgas condensers. An outgas condenser provides a collection surface that has a temperature below the volatilization temperature of the contaminants. A mechanism may be provided for scraping the contaminants from the collection surface of the condenser. The contaminants may be scraped directly into a contaminant collection bin. The bin should be maintained at a temperature below the volatilization temperature of the contaminants.

The second phase of the present invention is for removing metal from the ore. The second phase may occur within a plasma reactor. The plasma reactor includes a plasma reaction assembly that defines a plasma reaction chamber. A vacuum pump is provided for depressurizing the reaction chamber perhaps to a pressure below 1 Torr. The plasma reaction assembly has a mechanism for introducing a reactive gas such as chlorine into the reaction chamber. Two electrodes inside the reaction chamber generate a plasma. The plasma initiates a reaction between the reactive gas and the metal within the ore. During the reaction, the metal and reactive gas combine to form a metallic salt. The metallic salt is volatilized and collected on a condenser. The condenser provides a surface having a temperature below the temperature where the metallic salt changes from a gas to a liquid or a solid.

A plasma hopper may introduce the ore into the reaction chamber. In such a case a plasma conveyor belt may carry the ore through the chamber. The plasma conveyor belt can act as a plasma electrode. A bin for collecting gangue (i.e. the solid remaining after the ore has been fully processed) can be placed at the end of the plasma conveyor belt. The bin may be designed as a hopper to allow the gangue to exit the plasma reaction chamber once the metals have been removed. One or more heaters may be placed directly under the conveyor belt such that the heaters heat the metallic salts to a point where volatilization occurs. The heaters may be arranged in such a manner as to selectively remove the metallic salts from the ore.

The condenser may comprise the second plasma electrode. It may be in the form of the conveyer belt. The condenser is disposed within the reaction chamber and may be located such that it is above and parallel to the conveyor belt. The condensers collect the volatilized metallic salt through condensation. A mechanism for removing the metallic salt may be provided as part of the condensers. The mechanism may scrape the metallic salts from the condensers into a metallic salt collection bin. The metallic salt collection bin can be cooled such that the metallic salts do not volatilize in the bin.

DETAILED DESCRIPTION OF THE PREFERRED EMBODIMENTS

A preferred embodiment of the present process has two primary phases. In the first phase a contaminated ore 10 may be prepared and cleaned for use in the second phase. The contaminated ore 10 has a material that remains a solid throughout the entire process such as sand, dirt, or plant fiber. Additionally, the contaminated ore 10 may have contaminants 13 that have a low vaporization temperature in a low pressure environment such as sulfur, water, mercury and lead. During the first phase, contaminants 13 are removed from the contaminated ore 10 through evaporation, sublimation, or dispersal of trapped gases. During the second phase, metals 110 having higher melting points are removed through a low pressure plasma reaction.

Phase I

Figure 1:
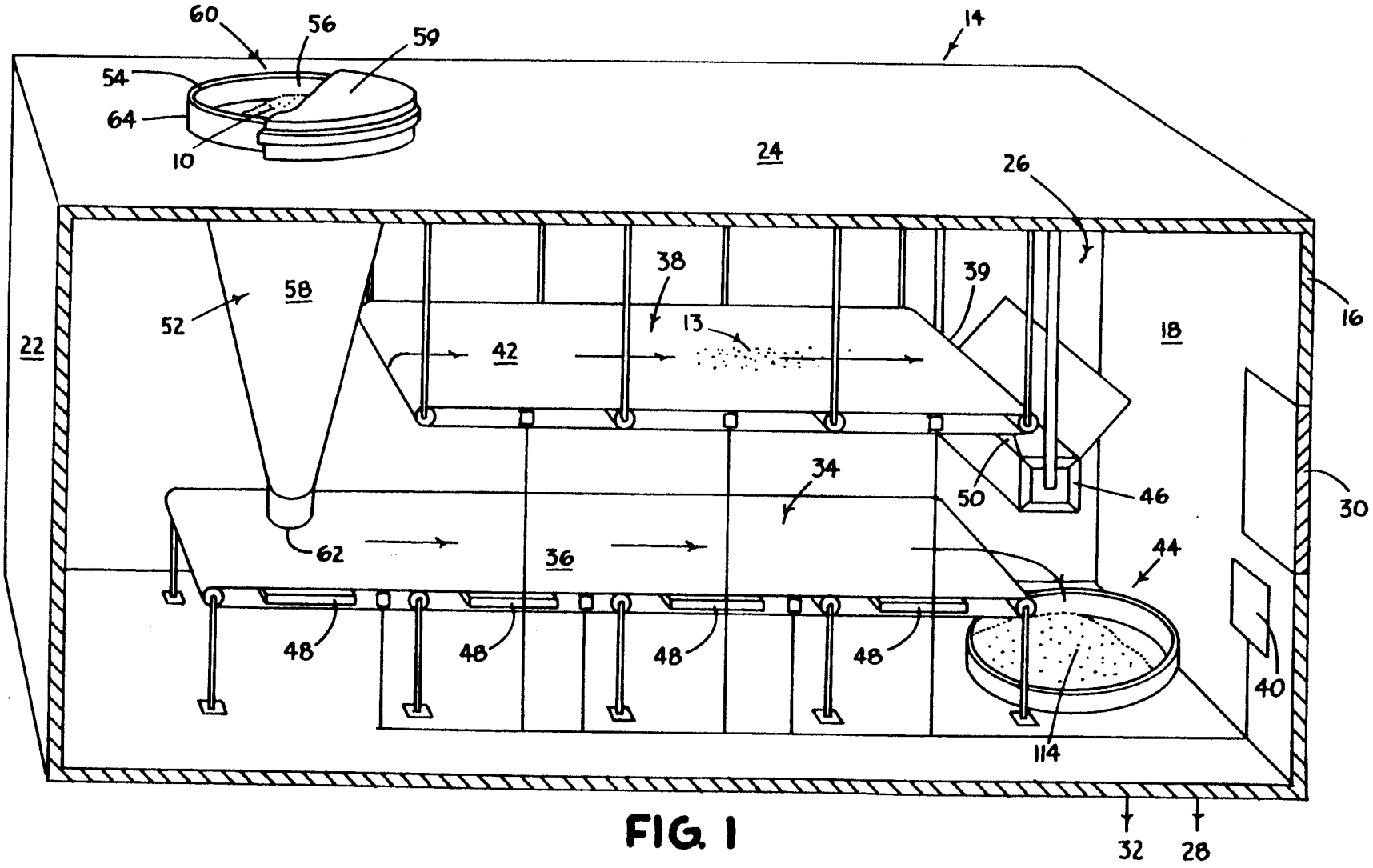
FIG. 1 shows the apparatus of the first phase.

The first phase of the present invention involves processing a contaminated ore 10 through an outgas assembly 14. An outgas hopper 52 may desirable to introduce the ore 10 to the outgas assembly 14. (Shown in FIG. 1) The outgas assembly 14 includes a vacuum pump 28 and mechanism for detecting pressure inside the outgas assembly 14 such as a pressure gauge 32. The outgas assembly 14 may also include an outgas conveyor belt 34, one or more outgas condensers 38, an ore collection bin 44, at least one contaminant collection bin 46 and at least one heater 48.

Gangue is the component of the ore 10 that remains a solid after processing through both phases. The contaminated ore 10 also may have at least one contaminant. Gangue may include such materials as soil, sand, gravel, rocks, tree fiber and plant fiber. This list is not intended to be exhaustive. Rather, it is provided for illustrative purposes only.

For the purposes of the present invention a contaminant is defined as any substance that will evaporate or sublimate under low pressures in the outgas assembly 14 with or without the application of heat. Contaminants 13 include, but are not limited to: sulfur, carbon dioxide, carbon monoxide, nitrogen, oxygen and water. The contaminants 13 generally are bound to other material in the contaminated ore 10. Other possible contaminants 13 can be identified by looking at phase diagrams of various elements or compounds. A phase diagram is a graph depicting pressure on one axis and temperature on the other axis. The phase diagram shows whether a particular element or compound is in a solid, liquid, or gas phase at a particular pressure and temperature. The phase diagrams of contaminants 13 will show a phase change from a solid or liquid to a gas at a pressure below atmospheric pressure with or without application of a moderate amount of heat. The purpose of the first phase in the present inventive process is to remove contaminants 13. The contaminants 13 are not needed and perhaps undesirable in the later stages of the present process.

The contaminated ore 10 desirably is pulverized or crushed to a fine particulate. The process of the present invention will remove contaminants 13 and metals 110 from a contaminated ore 10 of any size or shape. The extraction becomes more difficult, however, when the contaminant 13 or metal 110 is deeply imbedded in a particle of the contaminated ore 10. Contaminants 13 and metals 110 that are deep within a contaminated ore 10 (e.g. in the center of a rock) may never be removed due to the inaccessibility of the metal 110. Thus, if the contaminated ore particle is too large, some but not all the contaminants 13 will be removed. Pulverizing the contaminated ore 10 increases the accessibility of the contaminants 13 and metals 110 that were deeply imbedded within the contaminated ore 10. Desirably the contaminants 13 and metals 110 are adjacent or coextensive with the surface of the contaminated ore particles. In such a position, they are sufficiently exposed for the purposes of the present invention.

The size of the pulverized contaminated ore particle is preferably small enough to allow for extraction of all the contaminants 13. The size of the particles may be as small as dust particles. As previously mentioned, however, the present process will remove contaminants 13 and metals 110 from larger contaminated ore particles. Contaminants 13 and metals 110 will be removed with the present invention if they are subjected to the environment around the contaminated ore 10. Since most substances are porous enough to allow gas penetration through the surface of the contaminated ore 10, the contaminants 13 and metals 110 below the surface of the contaminated ore particles can be removed. However, gas penetration through the surface of the contaminated ore particles takes time. The percent recovery will decrease if the contaminated ore particles are too large. The size of the contaminated ore particles is too large if the gas cannot penetrate through the surface thereof.

The contaminated ore 10 may then be placed into an outgas hopper 52. The outgas hopper 52 is a holding area for the contaminated ore 10 before it enters the outgas assembly 14. The funnel-shape of the outgas hopper 52 as shown in the accompanying drawing has a circumferential wall 54 with inside and outside surfaces 56, 58. The circumferential wall 54 defines an upper opening 60 and a lower opening 62. The outgas hopper 52 can be attached adjacent or directly to an upper external surface 24 of an outgas assembly 14. The attachment area 64 should be sealed so that air does not seep around the outside surface 58 of the outgas hopper 52 and into the outgas assembly 14.

After the ore 10 is placed in the outgas hopper 52, the outgas hopper 52 may be sealed with a cover 59 (shown broken away). The cover 59 includes an o-ring 59*a* which forms a seal between the cover 59 and the circumferential wall 54 of the outgas hopper 52. (See FIG. 4). The outgas hopper 52 may be depressurized with the outgas assembly 14, and sealing the outgas hopper 52 prevents air seepage from the outside atmosphere into the outgas assembly 14. Ore 10 may be introduced into the outgas hopper 52 in batch jobs. A load lock or other mechanism may also be used to allow ore to be continually introduced into the outgas hopper 52 without depressurizing the outgas hopper 52 or the outgas assembly 14.

The outgas hopper 52 may release the contaminated ore 10 directly into the outgas assembly 14 where the contaminated ore 10 can be cleaned. The lower opening 62 of the outgas hopper 52 may be designed to provide contaminated ore 10 at a proper rate. If the lower opening 62 in the outgas hopper 52 is made larger, contaminated ore 10 will pass through more quickly. If the lower opening 62 is made smaller, contaminated ore 10 will pass into the outgas assembly 14 at a slower rate. Additionally, the lower opening 62 of the outgas hopper 52 can be constructed to disperse the contaminated ore 10 on the upper surface 36 of the outgas conveyor belt 34. Dispersal of the contaminated ore 10 helps to more fully subject the contaminated ore 10 to the environmental conditions inside the outgas assembly 14.

The outgas assembly 14 is a device that is used to remove any contaminants 13 that may interfere with the later stages of the present inventive process. The outgas assembly 14 has at least one wall 16 that defines an outgas chamber 26. The wall(s) 16 of the outgas assembly 14 have internal and external surfaces 18, 22. Windows 30 may be provided to see into the outgas chamber 26. All openings through the wall 16 of the outgas assembly 14 must be capable of being sealed to allow differentiation of pressure in the outgas chamber 26 as compared to the pressure acting on the external surface 22 of the outgas assembly 14. The walls 16 of the outgas assembly 14 along with all other parts that extend into or define the outgas chamber 26 must be capable of withstanding the pressure differentials to which they will be subjected (e.g., approximately one atmosphere). The outgas assembly 14 should have a vacuum pump 28 capable of substantially reducing the pressure in the outgas chamber 26. More than one vacuum pump 28 can be provided if desired. The pressure in the outgas chamber 26 may be reduced to a fraction of a single Torr. Pressure gauges 32 can be provided to give an accurate reading of the pressure in the outgas chamber 26.

The reduced pressure causes the contaminants 13 to evaporate or sublimate at lower temperatures than otherwise possible. The evaporation may occur at or below room temperature. Alternatively, one or more heaters 48 may be provided to increase the temperature inside the outgas chamber 26, thereby initiating the evaporation or sublimation. These contaminants 13 may be collected for other use. The reduced pressure also allows gaseous contaminants 13 such as $CO_2$, CO, $O_2$ and $N_2$ to escape from the contaminated ore 10. The gases, that were trapped into the contaminated ore 10 at atmospheric pressure, may be allowed to move more freely. Thus, they tend to disperse into other parts of the outgas chamber 26.

An outgas conveyor belt 34 may be disposed within the outgas chamber 26. The outgas conveyor belt 34 receives contaminated ore 10 from the outgas hopper 52 and carries the contaminated ore 10 to an ore collection bin 44. The outgas conveyor belt 34 may be constructed of stainless steel or inconel. The outgas conveyor belt is designed to withstand the low pressures within the outgas chamber 26. The length and width of the outgas conveyor belt 34 should be adjusted to accommodate the size of the outgas chamber 26. The speed of the belt rotation should provide an ample amount of time for the condensation of the contaminants 13. The ore collection bin 44 for collection of the ore 10 should be at the end of the outgas conveyor belt 34. When the ore 10 reaches the end of the outgas conveyor belt 34, the ore 10 falls off the belt 34. The ore 10 may fall directly into the ore collection bin 44.

The outgas assembly 14 may have one or more outgas condensers 38. The outgas condenser 38 provides a cool collection surface 42 that collects the contaminants 13 that have been evaporated or sublimated. Gaseous contaminants 13 may or may not be collected thereon. The effectiveness of the outgas condenser 38 may be altered through adjusting the temperature of the outgas condenser 38 and the pressure in the outgas chamber 26. Lower temperatures of the outgas condenser 38 and higher pressures in the outgas chamber 26 both increase the likelihood of obtaining condensation. Appropriate temperatures and pressures can be determined through experimentation or by reading phase diagrams of the pertinent contaminants 13. The outgas condenser 38 may have one or more temperature gauges 40 that show the temperature of the outgas condenser 38. These gauges 40 may be mounted on the external surface 22 of the walls 16 of the outgas assembly 14.

The outgas condenser 38 may be oriented parallel to the outgas conveyor belt 34. Alternatively, it may extend perpendicular thereto. The outgas condenser 38 may be supported or suspended directly above the outgas conveyor belt 34 by any manner known in the art. The evaporated or sublimated contaminants 13 will collect on any surface cool enough to cause condensation. Ideally the collection surface 42 of the condenser 38 is the only surface where such condensation occurs. If an appropriate surface is not provided the contaminants 13 may collect on the walls 16 of the outgas assembly 14 when the pressure in the outgas chamber 26 is increased. The outgas condenser 38 may be placed close enough to the outgas conveyor belt 34 so as to collect the contaminants 13 before they circulate throughout the outgas assembly 14. The condenser 38, however, should not be placed so close to the outgas conveyor belt 34 that the contaminants 13 do not evaporate or sublimate.

The outgas condenser 38 may be in the form of a conveyor belt. The outgas condenser 38 may be liquid cooled or otherwise maintained at a sufficiently low temperature to facilitate condensation. The outgas condenser 38 can rotate at a speed equivalent to or divergent from the speed of the outgas conveyor belt 34. The condenser 38, however, should be maintained at a temperature cool enough for condensation to occur thereon. As contaminants 13 build up on the collection surface 42 of the condenser 38, the surface area that is cool enough to cause further condensation may decrease in size and effectiveness.

To remove the condensate from the outgas condenser 38, an outgas scraper 50 can be used. The scraper may be constructed of any suitable material including ceramic or metal. The outgas scraper 50 may be placed near the end of the outgas condenser 38 if it is in the form of a conveyor belt. The outgas scraper 50 should be placed close enough to the condenser 38 so that the scraper 50 scrapes the condensate off the condenser 38. The outgas scraper 50 should be rigidly fixed adjacent the condenser 38, assuming the condenser 38 is in the form of a conveyer belt. This can be accomplished with a weld, bolts, or the outgas scraper 50 may be integral with the outgas condenser 38. If the condenser 38 is not in the form of a conveyer belt, the scraper 50 and the condenser 38 should be moved relative to each other such that outgas scraper 50 scrapes the collection surface 42 of the condenser 38. Once the condensate is scraped off the collection surface 42, it can then be collected for later use. Preferably the condensate is scraped off the outgas condenser 38 and directly into a contaminant collection bin 46. The contaminant bin 46 will need to be maintained at a temperature cool enough to prevent reevaporation or resublimation.

As previously mentioned the outgas assembly 14 may have one or more outgas heaters 48. The low pressure may not cause all the contaminants 13 to evaporate or sublimate at the ambient temperature. In such cases heaters 48 may be used. The heaters 48 can be placed directly underneath the outgas conveyor belt 34. The heaters 48 then cause the outgas conveyor belt 34 and the contaminated ore 10 thereon to obtain a temperature where volatilization takes place. A temperature gauge 40 may be provided to show the temperature of the contaminated ore 10. Such temperature gauges 40 may be mounted on the external surface 22 of the wall 16 of the outgas assembly 14.

Phase I—Operation

A contaminated ore 10, perhaps of soil containing metal, is collected. The contaminated ore 10 is pulverized to minimize the size of the contaminated ore particles. The size of the particles bears on how easy it is to remove the contaminants 13 and in later stages the metals 110 that will be extracted. The contaminated ore 10 can be placed into the upper opening 60 of the outgas hopper 52 before entering the outgas chamber 26. The pressure inside the outgas assembly 14 is reduced once all openings through the wall 16 of the outgas assembly 14 have been sealed. The pressure may be reduced as low as a fraction of a single Torr. The outgas hopper 52 allows the contaminated ore 10 to fall through the lower opening 62 in the outgas hopper 52 and onto the outgas conveyor belt 34 at a regulated rate.

When the contaminated ore 10 is placed into the outgas assembly 14, desirably the particles are spread out. The dispersal may be accomplished through the construction of the lower opening 62 of the outgas hopper 52 or by any other method including those known in the art. The dispersal allows each particle to have a greater surface area exposed to the local environment in the outgas chamber 26. The contaminants 13 evaporate or sublimate quicker and more easily when the exposed surface area of the individual particles is increased.

Heaters 48 inside the outgas assembly 14 can help provide the necessary temperature/pressure combination to initiate the evaporation or sublimation of the contaminants 13. Condensers 38 can be used to collect the contaminants 13 after evaporation or sublimation. If condensers 38 are not used the contaminants 13 will remain evaporated until the pressure is sufficiently increased to induce condensation. At such time the contaminants 13 will condense on the nearest cool surface. This may be the walls 16 of the outgas assembly 14. Condensers 38, however, will keep the condensation localized. Gaseous contaminants 13 (i.e. $CO_2$, $O_2$ $N_2$, and others) may not condense within the outgas assembly 14 or at ambient temperature and pressure. In such a case the gases will escape through the vacuum pump 28.

Once the contaminated ore 10 has been processed in the outgas assembly 14, the cleaned ore 10 can be collected. The outgas conveyor belt 34 may dump the ore 10 into an ore collection bin 44. The ore 10 is now prepared for later steps in the present inventive process.

The contaminants 13 may also be collected. The condensers 38 may be scraped with an outgas scraper 50. The contaminants 13 can be scraped into a contaminant bin 46. The bin 46 should remain cool enough so that the contaminants 13 do not reevaporate. The contaminants 13 may have commercial value in and of themselves. They may be removed and sold or discarded from the outgas chamber 26 in an appropriate manner.

The contaminants 13 and the ore 10 may be removed at anytime once separated. The present process, however, contemplates that they be left in the outgas chamber 26 until the contaminants 13 must be removed to provide additional space for more contaminants 13. The present process provides further processing the ore 10 without having to manually remove the ore 10 from the outgas chamber 26. In the subsequent processing metals are removed from the ore 10.

Phase II

The second phase removes metals from an ore 114. This phase of the process requires a plasma hopper 112, an ore 114, and a plasma reaction assembly 116. (Shown in FIG. 2) The plasma reaction assembly 116 may have a plasma conveyor belt 118 for the ore 114, one or more plasma condensers 120, a gangue collection bin 122, at least one metallic salt collection bin 124, one or more heaters 126, and plasma electrodes 180.

In the second phase, the metal 110 reacts with a reactive gas to form a metallic salt 132. The reaction takes place within a plasma 128 which is generated between plasma electrodes 180. The reactive gas may be a halogen such as chlorine. The large proportion of chlorine ions within the plasma 128 (as compared to the proportion of more stable diatomic chlorine molecules) greatly enhances the reaction rate between the chlorine and the metals in the ore 114. The salts 132 are volatilized into a gas. The salts 132 then are condensed on plasma condensers 120. The condensed metallic salts 132 are scraped from the condensers 120. The metals 110 are separated from the metallic salt 132 via various separation techniques including those known in the art.

The ore 114 may be a contaminated ore 10 that has been processed through phase 1 as described above or it may be processed through other processes now known or later developed. Depending on the ore 114, contaminants 13 may be left therein. The contaminants 13, however, should not disrupt the reactions in the second phase. The metal particles include, but are not limited to: Mo, Cu, Pb, Zn, Ag, Ni, Co, Mn, Fe, As, U, Au, Th, Sr, Cd, Sb, Bi, V, Ca, P, La, Cr, Mg, Ba, Ti, Al, Na, K, W, Zr, Sn, Y, Nb, Be, Os and Sc. Although this document uses the words "metal" and "metal particles", it should be understood that the process may pick up material that technically is not metal. It is believed that this process will remove any electro-positive atom or molecule. The metal needs, however, to form a metallic salt 132 at low pressures and the salt 132 should evaporate or sublimate. Alternatively, the salt 132 should dissolve out of the ore 114 when placed in a slightly acidic solution. It is within the skill of the art to determine which of the various atoms and molecules can be recovered with the present process having the present disclosure.

Figure 3:
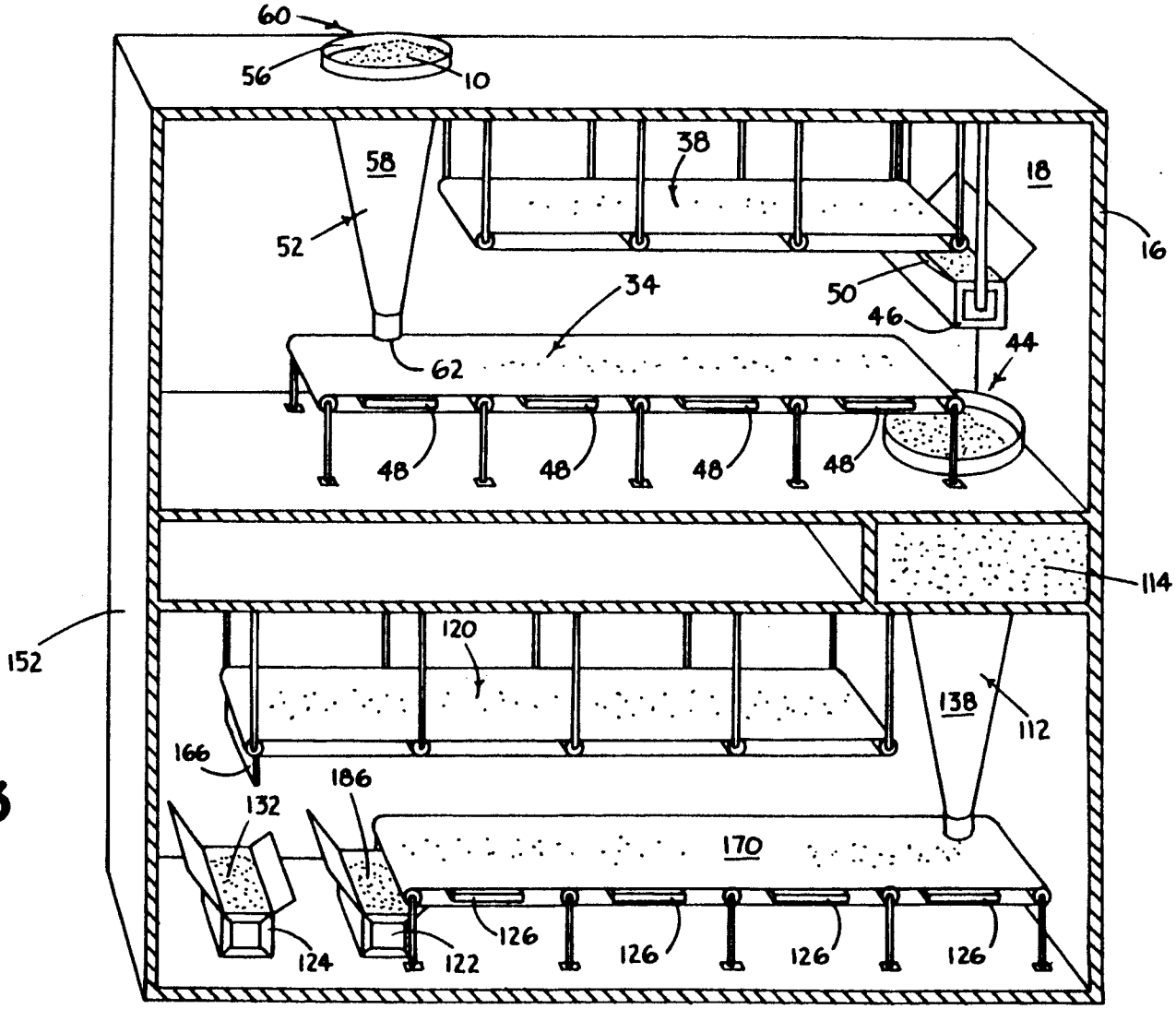
FIG. 3 shows the apparatus of the first phase disposed above and connected to the apparatus of the second phase.

If the ore 114 was processed in the outgas assembly 14, the ore 114 may be collected in plasma hopper 112 instead of in an ore collection bin 44. (As shown in FIG. 3) The plasma hopper 112 may have a structure that is similar to the outgas hopper 52. The plasma hopper 112 may be shaped much like a funnel. It has a circumferential wall 134 with internal and external surfaces 136, 138. The circumferential wall 134 defines an upper opening 140 and a lower opening 142.

If the ore 114 is finely pulverized, the plasma hopper 112 and the ore 114 contained therein act as a pressure plug between the outgas assembly 14 and the plasma reaction assembly 116. In this way the outgas assembly 14 and the plasma reaction assembly 116 can be maintained at different pressures, with no significant gas seepage therebetween. Thus, the pressure near the upper opening 140 of the plasma hopper 112 can differ from the pressure near the lower opening 142 of the plasma hopper 112.

Figure 2:
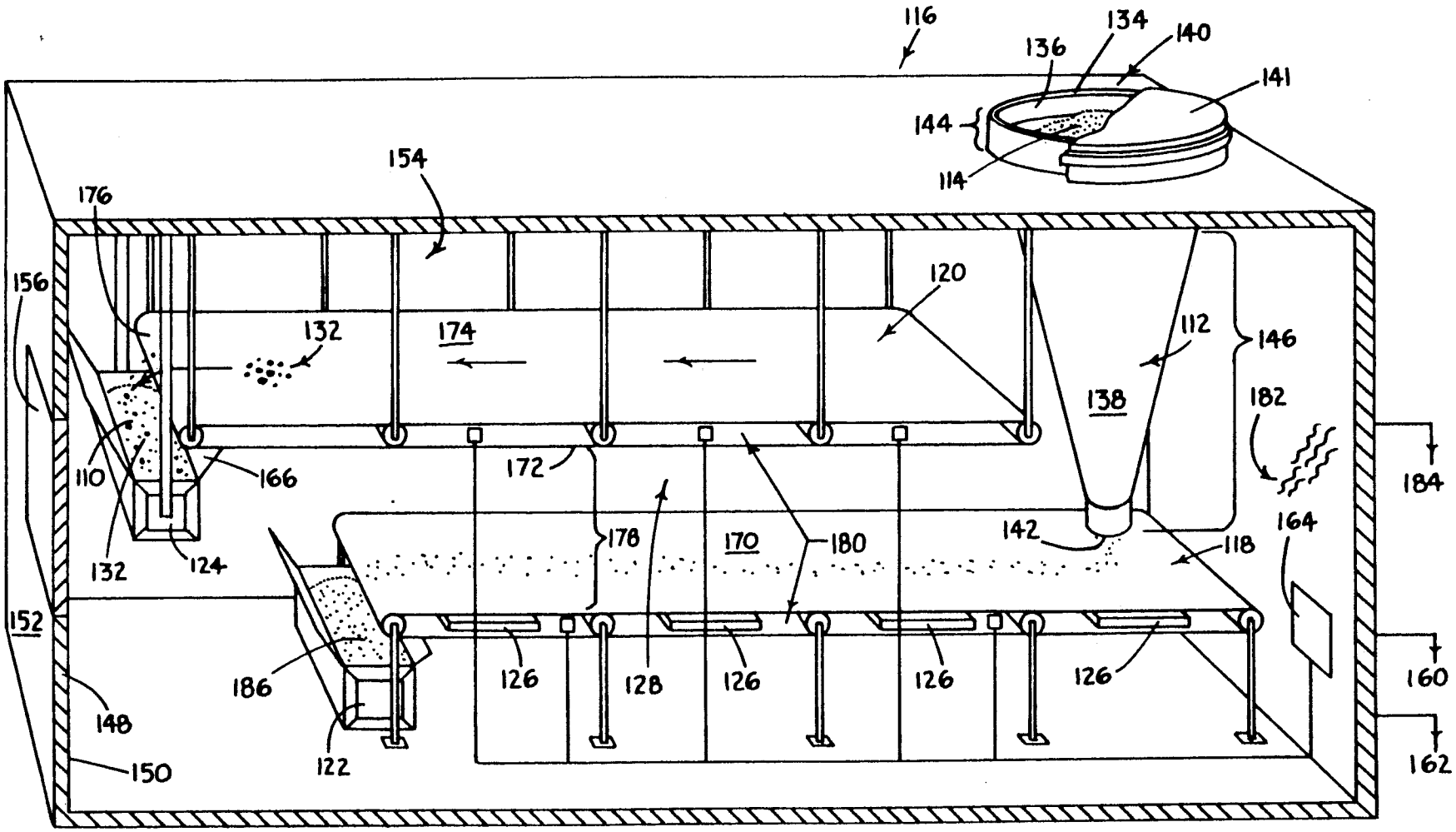
FIG. 2 shows the apparatus of the second phase.
Figure 4:
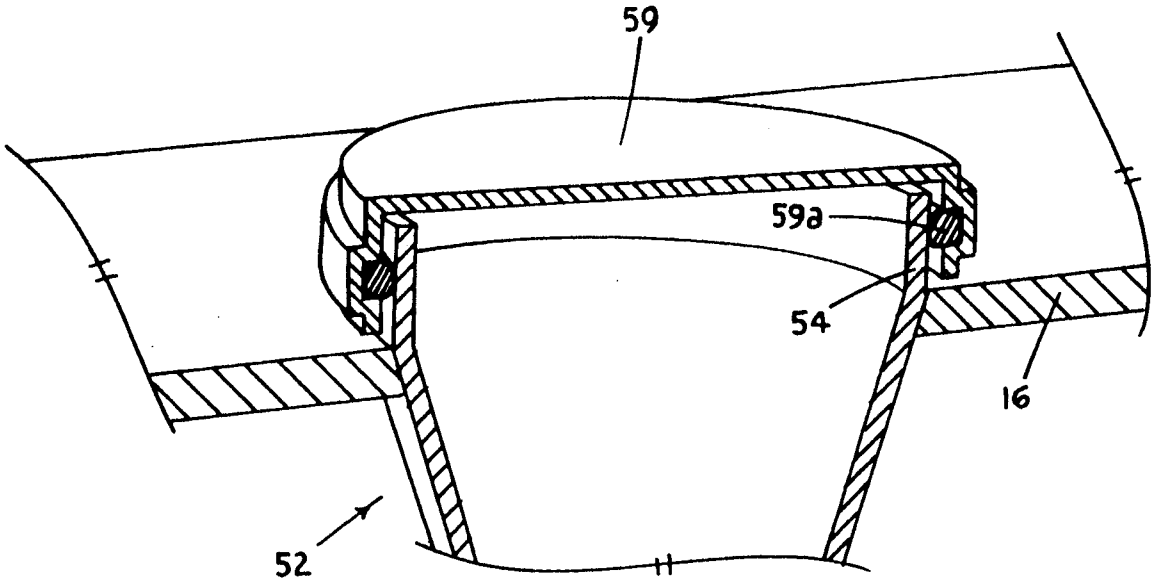
FIG. 4 shows the cover connected to the outgas hopper.

A cover 141 (shown broken away) can be placed over the plasma hopper 112 to retain appropriate pressures inside the plasma reaction assembly 116, if the plasma reaction assembly 116 is not joined to the outgas reaction assembly 14 (see FIG. 2). The cover 141 is designed similar to the cover 59. The cover 141 includes an o-ring, which is like the o-ring 59*a*. The cover 141 seals to the plasma hopper 112 in the same manner as the cover 59 seals to the outgas hopper 52. The cover 59, the o-ring 59*a* and the seal between the cover 59 and the outgas hopper 52 are shown in FIG. 4.

The outgas assembly 14 may be disposed above the plasma reaction assembly 116. An upper portion 144 of the plasma hopper 112 may protrude from the lower internal surface 20 of the wall 16 of the outgas assembly 14 near the end of the outgas conveyor belt 34. In this position, the plasma hopper 112 may function as an ore collection bin 44 for the ore 114 in the outgas assembly 14 and as a plasma hopper 112 in the plasma reaction assembly 116. A lower portion 146 of the plasma hopper 112 extends into plasma reaction assembly 116. The plasma hopper 112 in turn may feed the ore 114 into the plasma reaction assembly 116 and perhaps onto the plasma conveyor belt 118. The plasma hopper 112 like the outgas hopper 52 may be designed to control the flow rate of the ore 114. The ore 114 may be dispersed onto the plasma conveyor belt 118, thereby more fully subjecting the ore 114 to the plasma 128 in the plasma reaction assembly 116.

The plasma reaction assembly 116 is a device designed to assist in removing metals 110 from the ore 114. The plasma reaction assembly 116 itself, is similar to the outgas assembly 14 in construction. The plasma reaction assembly 116 has one or more walls 148, having internal and external surfaces 150, 152 and defining a plasma reaction chamber 154. Windows 156 may be provided in the wall(s) 148 of the plasma reaction chamber 154 to allow viewing of the plasma reaction chamber 154 from an area remote therefrom. Any opening through the wall 148 of the plasma reaction chamber 154 must be capable of being sealed so that the pressure in the plasma reaction chamber 154 can be substantially reduced. The plasma reaction assembly 116 may be capable of obtaining and withstanding pressures of at least as low as 1 to 5 Torr.

A plasma vacuum pump 160 is used to reduce the pressure of the plasma reaction assembly 116. Pressure gauges 162 may be provided to show the pressure in the plasma reaction chamber 154. The plasma vacuum pump 160 should bring the pressure inside the reaction assembly 116 down to below 10 microns (below $10^{-2}$ mm Hg). The pressure inside the plasma reaction chamber 154 is important, because plasmas are more easily generated and maintained in low pressure environments. Furthermore, as the pressure is lowered the metallic salts 132 evaporate or sublimate at lower temperatures. Using reduced pressure instead of heat for evaporation is also believed to save energy.

The plasma reaction chamber 154 may contain a plasma conveyor belt 118 for carrying the ore 114, one or more temperature gauges 164, one or more heaters 126, a gangue bin 122, one or more plasma condensers 120, a one or more plasma scraper 166 and one or more metallic salt collection bins 124.

The plasma conveyor belt 118 receives ore 114 from the plasma hopper 112. Then it carries the ore 114 a predetermined distance; the length of the plasma conveyor belt 118. The plasma conveyor belt 118 is sized to be received within the plasma reaction chamber 154, while not interfering with the other activities therein. While the ore 114 travels the length of the plasma conveyor belt 118, metals are converted to metallic salts 132 and are removed from the ore 114. Thus, the plasma conveyor belt 118 should move slow enough to allow sufficient time to remove the metals. At the end of the belt 118, the gangue 186 is dumped into a gangue bin 122. Since the plasma conveyor belt 118 performs functions similar to the outgas conveyor belt 34, both conveyor belts 118, 34 have similar structural elements.

Heaters 126 may be provided underneath or as part of the plasma conveyor belt 118. Once the metals are converted to metallic salts 132 they are removed from the ore 114 through evaporation or sublimation. The salts 132 may evaporate at ambient temperature in the low pressure. If the salts 132 do not evaporate, however, at least one heater 126 may be provided to increase the temperature of ore 114, thereby initiating evaporation or sublimation. These heaters 126 may be set at different temperatures to selectively remove salts 132 in the same manner as described in reference to selectively removing contaminants 13 from the ore 10. Temperature gauges 164 may be provided to show the temperature of the ore 114 at different locations along the plasma conveyor belt 118.

When the ore 114 reaches the end of the plasma conveyor belt 118, it is dumped into a gangue bin 122. The ore 114 at the end of the plasma conveyor belt 118 should be spent and is generally called gangue 186. It is appreciated that it may become cost inefficient to increase the speed of the plasma conveyor belt 118 beyond a certain speed because too much metal will be lost, i.e., will not be converted. It is also appreciated that it may be cost inefficient to slow the speed of the plasma conveyor belt 118, because not enough additional metal will be recovered. The speed of the plasma conveyor belt 118 is desirably set to provide the greatest economic output.

Immediately above the upper side 170 of the plasma conveyor belt 118 may be the lower side 172 of a plasma condenser 120. There may be one or more plasma condensers 120 and they may be parallel or perpendicular to the plasma conveyor belt 118. The condensers 120 collect the evaporated or sublimated metallic salts 132. The lower side 172 of the plasma condenser 120 may be substantially closer to the ore 114 than any other cool surface. In this location the gaseous metallic salts 132 preferentially condense on the plasma condenser 120 rather than on any of the other cool surfaces in the plasma reaction assembly 116.

The plasma condensers 120 must be cool enough to initiate condensation thereon. Like the outgas condensers 38 the plasma condensers 120 may be in the form of a conveyer belt. Both the plasma and the outgas condensers 120, 38 that are in the form of a conveyor belt must rotate fast enough to provide a collection surface 174, 42 capable of initiating condensation. The speed of rotation may vary between ores 114, since the amount of condensation and the thermal conductivity of the condensate (metallic salts 132) can vary between the ores 114. The plasma conveyor belt 118 may be cooled by water cooling pipes or otherwise maintained at a cool temperature. Temperature gauges 164 may be provided to show the temperature of the collection surface 174.

Plasma scrapers 166 are provided to prevent the plasma condenser 120 from becoming too heavily coated with condensate 132 such that efficiency is reduced. Plasma scraper 166 is provided for each plasma condenser 120. The plasma scrapers 166 should not readily conduct the electrical charge passing through the plasma condensers 120. Thus, one suitable material for the scraper 166 is ceramic. The plasma scrapers 166 are structurally similar to the outgas scrapers 50, since they both operate in substantially the same manner. Both scrapers 166, 50 scrape the condensate 132, 13 from the condensers 120, 38, thereby increasing the size of the collection surfaces 174, 42. Both scrapers 166, 50 may be mechanically moved along the condensers 120, 38. Alternatively, if the condensers 120, 38 are in the form of a conveyor belt, the scrapers 166, 50 may be rigidly fixed adjacent the end 176, 39 thereof. The plasma scrapers 166 may scrape condensate 132 off the plasma condensers 120 and into a metallic salt collection bin 124.

The metallic salt collection bins 124 hold the metal salts 132 until they are removed. There may be at least one metal collection bin 124. The metal collection bins 124 should be maintained at a cool enough temperature to prevent reevaporation or resublimation of the metallic salts 132. When the metal collection bins 124 are full, the plasma reaction chamber 154 may be repressurized so the metallic salt collection bins 124 can be manually removed. Alternatively, a load lock or other mechanism may also be used to allow the metallic salts 132 to be removed without repressurizing the plasma reaction chamber 154. The condensed salts 132 may then be further processed by commonly known chemical processes to extract desired metals from the metallic salts 132.

The gangue bin 122 may be removed when the metallic salt collection bin 124 is removed. Alternatively, the gangue bin 122 could be constructed with a load lock or other mechanism to allow the gangue 186 to be removed without repressurizing the plasma reaction chamber 154. The gangue 186 may then be further processed or disposed in an appropriate manner.

A plasma 128 is generated between the plasma electrodes 180 in the plasma reaction chamber 154. The plasma initiates a reaction causing metals in the ore 114 and reactant gas 182 to yield a metallic salt 132. The reaction is believed to take place as follows:

$$Cl_{2(gas)} \xrightarrow{plasma(e^-)} 2Cl^-_{(gas)}$$

$$Au^+_{(solid)} + Cl^-_{(gas)} \xrightarrow{heat} Au^+Cl^-_{(gas)} + e^-$$

Chlorine and gold were used for illustrative purposes only. The reaction as described herein will occur between other metals and reactive gases 182.

A controlled plasma may be generated in a plasma zone 178, which is located between the plasma conveyor belt 118 and the plasma condenser 120. The plasma conveyor belt 118 and the plasma condenser 120 may serve as plasma electrodes 180. The controlled plasma acts as a source of heat for the ore 114. The heat of the plasma and the ionic concentration of the reactant gas 182 within the plasma allows the reactant gas 182 to readily combine with metals in the ore 114 to form metallic salts 132. The heat of the plasma may also allow the metallic salts 132 to immediately volatilize into gaseous salts 132.

The plasma reaction assembly 116 has a reactant gas inlet 184. The gas inlet 184 is a mechanism for introducing reactant gas 182 into the de-pressurized plasma reaction assembly 116. First the plasma reaction assembly 116 is de-pressurized. When the de-pressurizing is complete the reactant gas inlet 184 allows some reactant gas 182 to escape into the plasma reaction chamber 154. This is called back-filling. The plasma reaction assembly 116 may be back-filled with reactant gas 182 to a pressure of 1–5 Torr.

The reactant gas 182 may be a halogen such as Cl, F, Br, I, or At. The reactant gas 182 must be a gas under the low pressures found in the plasma reaction chamber 154. Furthermore, it is believed that the important characteristic of the reactant gas 182 is its tendency toward becoming electro-negative. It is within the skill of the art to determine the amount of electro-negativity necessary for the present process, having the present disclosure. The amount of electro-negativity required to recover a particular metal 110 may vary from metal to metal. Fluorine and chlorine have been used and are acceptable for the purposes of the present inventive process. Once, the gas 182 combines with the metal 110 in the ore 114, the resultant salt 132 must be susceptible of being a gas 182 under the low pressures of the plasma reaction chamber 154.

Specific salts can be made, if the amount of each metal present in the ore 114 is known. To make specific salts, the reactant gas 182 may include more than one distinct type of gas such as Fluorine and Chlorine. The most reactive gas is believed to react with the most reactive metal before any other gas reacts with any other metal. When the most reactive gas is depleted, the second most reactive gas will begin reacting with a metal. If the amount of each particular metal in a sample is known, an appropriate amount of an appropriate gas may be allowed into the plasma reaction chamber.

The present process has several special advantages. Because the volatilization reaction occurs in a low pressure environment, volatilization occurs at comparatively low temperatures. The low temperature of volatilization helps reduce the power required, reducing the cost of the process. The reduced pressure of the plasma reaction assembly 116 and the highly localized nature of the controlled plasma 128 helps to thermally insulate the plasma zone 178. This reduces the heat transferred from the plasma zone 178 to the rest of the plasma reaction assembly 116. Therefore the plasma reaction assembly 116 does not need to be constructed of materials that are able to withstand the high temperatures of the plasma zone 178. The thermal insulation also reduces the power requirements for the process, reducing cost.

Because the plasma condenser 120 is considerably closer to the ore than any other cool surfaces of the plasma reaction assembly 116, the gaseous metallic salts 132 preferentially condenses on the plasma condenser 120. The minimal condensation that occurs on the other surfaces aids in reducing heat transfer from the plasma zone 178, and further aids in reduced cleaning of the plasma reaction assembly 116. The large proportion of condensation occurring on the plasma condenser 120 also increases the efficiency of collection of the metallic salts 132.

Phase II—Operation

A plasma reaction chamber 154 is de-pressurized. Reactant gas 182 is allowed to enter the plasma reaction chamber 154. Once the gas 182 is in place the pressure may be as low or lower than 1–5 Torr. Next, an ore 114 is placed in a plasma reaction chamber 154. This may occur via a plasma hopper 112 and the ore 114 may be placed on a plasma conveyor belt 118. The ore 114 is subjected to a plasma 128. The resultant metallic salts 132 are evaporated or sublimated. Then the salts 132 are captured through condensation. The condensation may occur on condensers 120. Next, the salts 132 are collected and removed from the plasma reaction chamber 154. The metals 110 are then extracted from the metallic salts 132 using known separation methods.

A final bath in an acid or other solvent may be required in cases where the gangue 186 contains traces of a metallic salt 132 for which complete recovery is essential. This solvent dissolves the trace of salt 132 left in the gangue 186. The gangue 186 is then separated from the solvent/salt mixture. Then the salt 132 is recovered from the wash by precipitation or 10 drying methods.

For example, assume a ton of ore 114 contains 10 grams of metal 110 to be removed and one half of the metal 110 is recovered on the condensers 120 in the phase II reaction. Also assume the remainder of the metal 110 is in the gangue 186 in the form of a salt 132. The gangue 186 may be mixed with dilute HCL or other appropriate solvent. This slurry is passed through a filter that separates the acid/salt mixture from the gangue 186. The salt 132, which is now dissolved in the HCL is then recovered by electrolysis, drying or precipitation and the full 10 grams originally in the ton of ore 114 are thereby recovered.

EXAMPLE 1

The process and apparatus of the present invention was used to extract metals 110 from a low grade ore 10, not previously considered economically worth metal recovery costs. The results of this example show the ore 10 to be economically worth the metal recovery costs of the present invention.

The ore 10 was crushed prior to introduction to the outgas assembly 14. The ore 10 was outgassed for several minutes at a pressure of 1 Torr. The temperature of the outgas chamber 26 was maintained above 500° C.

The pressure of the plasma reaction assembly 116 was drawn down to less than 10 microns, and back-filled with chlorine gas to a pressure of 5 Torr. The ore 114 was processed in the plasma reaction assembly 116 for several minutes. As the ore 114 was drawn through the plasma zone, the chlorine gas reacted with the metals 110 in the ore 114, forming chlorine-metal salts 132. The metallic salts 132 were immediately volatilized due to the heat of the plasma 128. The gaseous chlorine-metal salts 132 condensed on the plasma condenser 120 due to its cool temperature and relative proximity. The condensed chlorine-metal salt 132 was collected separate from the spent ore 114.

An elemental analysis was conducted on the condensed salt 132, which showed the following metal 110 concentrations:

| | | |
|---|---|---|
| Fe | 50.89% | |
| Cr | 23585 | ppm |
| Ti | 0.7% | |
| Zn | 3251 | ppm |
| Mo | 128 | ppm |
| Ag | 306.4 | ppm |
| As | 59 | ppm |
| Th | 6 | ppm |
| Cd | 0.2 | ppm |
| Bi | 115 | ppm |
| Ca | 0.08% | |
| La | 36 | ppm |
| Ba | 81 | ppm |
| Al | 0.15% | |
| K | 0.10% | |
| Zr | 87 | ppm |
| Y | 7 | ppm |
| Be | 14.9 | ppm |
| Ni | 84413 | ppm |
| Mn | 6949 | ppm |
| Au | 4044 | ppm |
| Cu | 2908 | ppm |
| Pb | 1094 | ppm |
| Co | 192 | ppm |
| U | 60 | ppm |
| Sr | 10 | ppm |
| Sb | 2 | ppm |
| V | 131 | ppm |
| P | 0.035% | |
| Mg | 0.09% | |
| Ti | 0.70% | |
| Na | 0.18% | |
| W | 2 | ppm |
| Sn | 1 | ppm |
| Nb | 13 | ppm |
| Sc | 0.5 | ppm |

The iron, nickel, chromium, and gold values obtained from the ore 10 in this example indicate that large scale extraction by the present inventive process would be profitable.

Although the present invention has been described with reference to preferred embodiments, workers skilled in the art will recognize that changes may be made in form and detail without departing from the spirit and scope of the invention.

What is claimed is:

1. A process for extracting metal from ore, comprising the steps of:

creating a reduced pressure environment which contains a reactionable amount of a reactive gas;

generating a plasma within the reduced pressure environment;

exposing the ore to the plasma within the reduced pressure environment such that the reactive gas chemically reacts with the metal to form salt; and extracting the salt from the ore.

2. The process of claim 1 further comprising the step of:

processing the ore into a particulate to increase the surface area of the ore.

3. The process of claim 1 further comprising the step of:

creating a preliminary reduced pressure environment; and preliminarily exposing the ore to the preliminary reduced pressure environment to remove contaminants.

4. The process of claim 1 further comprising the step of:

creating a preliminary elevated temperature environment; and preliminarily exposing the ore to the preliminary elevated temperature environment to remove contaminants.

5. The process of claim 1 wherein the reduced pressure environment is at a pressure below 20 Torr.

6. The process of claim 5 wherein the reduced pressure environment is at a pressure between 1 and 5 Torr.

7. The process of claim 1 wherein the reactive gas is a halogen.

8. The process of claim 7 wherein the reactive gas is chlorine.

9. The process of claim 1 wherein the reactive gas is composed of a plurality of reactive gasses, wherein the gasses selectively react with specific metals to form distinct salts.

10. The process of claim 9 wherein the distinct salts are separable.

11. The process of claim 1 wherein the metal is a noble metal.

12. The process of claim 1 wherein the plasma is generated in a thermally insulated zone for reducing heat transfer from the plasma out of the thermally insulated zone.

13. The process of claim 1, further comprising the step of:

removing the salt from the ore by volatilization.

14. The process of claim 13, further comprising the step of:

heating the ore to remove the salt by volatilization.

15. The process of claim 13, further comprising the step of:

condensing the volatilized salt on a condensing surface.

16. The process of claim 15 wherein the plasma is generated between a first electrode and a second electrode within the reduced pressure environment, the process further comprising the step of:

cooling the second electrode to provide the condensing surface.

17. The process of claim 1 wherein the ore is exposed to the plasma for a duration sufficient to remove substantially all of the available metal values.

18. A process for extracting a metal from an ore the process occurring in a plasma reaction assembly that defines a plasma reaction and in the presence of a reactive gas and a plurality of plasma electrodes, the process comprising the steps of:

reducing the pressure in the plasma reaction chamber;

injecting the reactive gas into the plasma reaction chamber;

generating a plasma between the plasma electrodes and within the plasma reaction chamber;

exposing the ore to the plasma within the plasma reaction chamber, such that the reactive gas reacts with the metal to form a metallic salt; and volatilizing the metallic salt to extract the metallic salt from the ore.

19. The process of claim 18 further comprising the step of:

crushing the ore prior to putting the ore into the plasma reaction chamber.

20. The process of claim 18 carried out in the presence of at least one condenser with a condensing surface, said process further comprising the steps of:

condensing the volatilized metallic salts to form a condensed metallic salt on the condensing surface.

21. The process of claim 20 further comprising the step of:

removing the condensed metallic salts from the condensers.

22. The process of claim 21 further comprising the step of:

removing and collecting the condensed salt separate from the gangue.

23. The process of claim 21 wherein the step of removing further comprises:

removing the salts by scraping the condensers.

24. The process of claim 23 carried out in the presence of a metallic salt collection bin, the process further comprising the steps of:

removing the condensed metallic salts by scraping the condensers to remove the condensed metallic salts into the metallic salt collection bin.

25. The process of claim 24 further comprising the step of:

cooling the metallic salt collection bin.

26. The process of claim 20 wherein the condenser is a condensing conveyor belt, the process further comprising the step of:

rotating the condensing conveyor belt.

27. The process of claim 18 carried out in the presence of at least one heater, the process further comprising the steps of:

heating the ore with the heaters to induce volatilization of the metallic salts within the contaminated ore.

28. The process of claim 27 further comprising the steps of:

arranging the heaters to create a plurality of zones at different temperatures; and selectively removing a specific metallic salt from the ore in each of the zones.

29. The process of claim 18 conducted in the presence of a plasma conveyor belt, the process further comprising the steps of:

depositing the ore into the plasma chamber and onto the plasma conveyor belt; and moving the conveyor belt to carry the ore through the plasma.

30. The process of claim 29 carried out in the presence of a gangue collection bin, the process further comprising the steps of:

removing the gangue from the conveyor belt and into the gangue collection bin.

31. The process of claim 18 the step of injecting further comprising:

injecting a halogen as the reactive gas.

32. The process of claim 31 the step of injection further comprising:

injecting chlorine as the reactive gas.

33. The process of claim 18, the process further comprising the step of:

cooling at least one electrode of the plurality of electrodes to provide the condensing surface.

34. The process of claim 18 the process further comprising the step of:

maintaining the pressure in the plasma reaction chamber at a pressure below 20 Torr during the steps of generating, exposing and volatilizing.

35. The process of claim 34 the step of maintaining further comprising:

maintaining the pressure in the plasma reaction chamber at a pressure between 1 and 5 Torr.

36. The process of claim 18 wherein the step of injecting occurs before the step of reducing.

37. The process of claim 18 wherein the process is continual.

38. A plasma reactor for extracting metal values from ore, comprising:

means for defining a plasma reaction chamber;

means for de-pressurizing the plasma reaction chamber to a reduced pressure;

means for introducing the ore into the plasma reaction chamber;

means for introducing a reactionable amount of a reactive gas into the plasma reaction chamber, said reactive gas being able to react with the metal values in the ore to form salts;

first electrode means and second electrode means for generating a plasma about the ore within the plasma reaction chamber for facilitating the reaction between the reactive gas and the metal values in the ore to form salts.

39. The plasma reactor of claim 38 further comprising:

means for heating the ore to volatilize the salt at the reduced pressure.

40. The plasma reactor of claim 39 further comprising:

a condensing surface upon which to condense the volatilized salt away from the gangue.

41. The plasma reactor of claim 38 further comprising:

means for defining a preliminary outgas chamber to remove contaminants from the ore.

42. The plasma reactor of claim 41 further comprising:

hopper means for gravitationally feeding ore from the preliminary outgas chamber to the plasma reaction chamber.

43. The plasma reactor of claim 42 wherein the hopper means contains ore which functions as a pressure plug between the plasma reaction chamber and the preliminary outgas chamber.

44. The plasma reactor of claim 38 wherein the first electrode means comprises ore conveyor belt means for carrying the ore through the plasma reaction chamber.

45. The plasma reactor of claim 38 wherein the second electrode means comprises condenser conveyor belt means for condensing the volatilized salt and for carrying the condensed salt through the plasma reaction chamber.

46. The plasma reactor of claim 45 further comprising means for cooling the condenser conveyor belt means.

47. The plasma reactor of claim 38 wherein the first electrode means comprises ore conveyor belt means for carrying the ore through the plasma reaction chamber; and the second electrode means comprises condenser conveyor belt means for condensing the volatilized salt and for carrying the condensed salt through the plasma reaction chamber.

48. The plasma reactor of claim 47 wherein the ore conveyor belt means and the condenser conveyor belt means are parallel.

49. The plasma reactor of claim 48 wherein the ore conveyor belt means and the condenser conveyor belt means move in the same direction for preferentially condensing the gaseous salt on the condenser conveyor belt means.

50. The plasma reactor of claim 49 wherein the ore conveyor belt means and the condenser conveyor belt means move at the same speed for preferentially condensing the gaseous salt on the condenser conveyor belt means.

51. The plasma reactor of claim 38 further comprising:

at least one heater, wherein the heaters are located inside the plasma reaction chamber and directly under the plasma conveyor belt.

52. The plasma reactor of claim 38 further comprising:

means for removing metallic salts from the condensers.

53. The plasma reactor of claim 52 further comprising:

means for containing a metallic salt which has been removed from the condenser.

54. The plasma reactor of claim 38 further comprising:

means for continually introducing a contaminated ore into the reaction chamber, while the plasma is present.

55. The plasma reactor of claim 38 further comprising:

means for containing gangue wherein the means for containing at least partially disposed with the reaction chamber.

56. The plasma reactor of claim 55 further comprising:

means for continually removing gangue from the reaction chamber through the means for containing.

57. The process of claim 18 wherein all of the ore is converted into metallic salt such that after the metallic salt is extracted there is no remaining gangue.

* * * * *